US007913981B2

(12) United States Patent
Rohde et al.

(10) Patent No.: US 7,913,981 B2
(45) Date of Patent: Mar. 29, 2011

(54) CABLE RELEASE LEVER

(75) Inventors: John Rohde, Lincoln, NE (US); Ronald Faller, Lincoln, NE (US); Dean Sicking, Lincoln, NE (US); Jim Holloway, Lincoln, NE (US); John Reid, Lincoln, NE (US); Robert Bielenberg, Lincoln, NE (US); Karla Polivka, Lincoln, NE (US)

(73) Assignee: The Board of Regents of the University of Nebraska, Lincoln, NE (US)

( * ) Notice: Subject to any disclaimer, the term of this patent is extended or adjusted under 35 U.S.C. 154(b) by 0 days.

(21) Appl. No.: 11/280,612

(22) Filed: Nov. 16, 2005

(65) Prior Publication Data

US 2006/0102884 A1 May 18, 2006

Related U.S. Application Data

(60) Provisional application No. 60/628,213, filed on Nov. 16, 2004.

(51) Int. Cl.
*E01F 15/00* (2006.01)
*E01F 13/00* (2006.01)

(52) U.S. Cl. ..... 256/13.1; 404/6

(58) Field of Classification Search ..... 256/13.1; 439/504; 404/6; 24/68 FP See application file for complete search history.

(56) References Cited

U.S. PATENT DOCUMENTS

| | | | | |
|---|---|---|---|---|
| 4,838,523 | A * | 6/1989 | Humble et al. | 256/13.1 |
| 5,022,782 | A * | 6/1991 | Gertz et al. | 404/6 |
| 5,039,066 | A * | 8/1991 | Stacey | 256/13.1 |
| 5,797,591 | A * | 8/1998 | Krage | 256/13.1 |
| 6,065,738 | A * | 5/2000 | Pearce et al. | 256/13.1 |
| 6,398,192 | B1 * | 6/2002 | Albritton | 256/13.1 |
| 6,729,607 | B2 * | 5/2004 | Alberson et al. | 256/13.1 |
| 6,932,327 | B2 * | 8/2005 | Alberson et al. | 256/13.1 |
| 2003/0015695 | A1 * | 1/2003 | Alberson et al. | 256/13.1 |
| 2003/0213946 | A1 * | 11/2003 | Alberson et al. | 256/13.1 |
| 2003/0222254 | A1 * | 12/2003 | Bergendahl | 256/13.1 |

OTHER PUBLICATIONS

John D. Reid, Nicholas R. Hiser and Tony J. Paulsen, Simulation and Bogie Testing of New Cable Barrier Terminal IMECE2003-44104, App. A, Nov. 2003, University of Nebraska-Lincoln.

Brian A. Coon, Ronald K. Faller and John D. Reid, Cable Barrier Literature Review, MwRSF Research Report No. TRP-03-118-02, Jul. 10, 2002, University of Nebraska.

* cited by examiner

*Primary Examiner* — Victor MacArthur
(74) *Attorney, Agent, or Firm* — Advent IP, P.C., L.L.O.

(57) ABSTRACT

A system and method for a device for releasing a cable of a safety system is disclosed. The system and method disclose various features of the cable system as it applies to a roadway barrier system and other applications in the event that the cables are impacted generally longitudinally proximate the region they are secured to a surface.

13 Claims, 7 Drawing Sheets

CABLE RELEASE LEVER

CROSS-REFERENCE TO RELATED APPLICATIONS

This application claims the benefit of U.S. Provisional Application Ser. No. 60/628,213 filed on Nov. 16, 2004.

STATEMENT REGARDING FEDERALLY SPONSORED RESEARCH OR DEVELOPMENT

Not applicable.

BACKGROUND

Cable systems have often been used as safety systems for roadside barriers or as tie-down measures for securing equipment such as antennas, towers, or safety fences/netting. Using cable systems for these purposes requires that the cables be maintained in constant tension and not break loose. If not, they would fail as a securing mechanism. The cable used in these systems is typically manufactured from heavy gauge steel wire, rated to maintain a desired loading. Unexpected failure of the cable safety system can result in significant property damage to the item being secured, as well as potential injury or fatality to bystanders.

Prior art mechanisms that release a cable from its anchor have traditionally relied on the fracture of a post or support. In these mechanisms, the cable is passed through the base of a post such that when the post fractures on impact, the cable is freed from its anchor.

As previously mentioned, roadside barriers have been known to use cable safety systems as guardrails. In such an arrangement, at least one cable is supported by relatively weak steel posts. The steel cables are pre-tensioned with an initial load, and are anchored at both ends of the system. The anchoring typically occurs along a surface such as the roadside or ground. When an errant vehicle obliquely impacts the system, which is most commonly a three cable system, the cables have sufficient tension in them to absorb the impact and redirect the vehicle back towards the driving surface, effectively shielding the roadside hazard and increasing the safety of the vehicle operator. This is especially important on roads that do not have other types of barriers that could perform similar functions (i.e. curbs, concrete walls). Numerous fatalities and injuries have been attributed to vehicles leaving the road and either rolling or entering opposing traffic lanes, thereby potentially endangering other motorists, as well as the occupants of the errant vehicle. The support posts alone offer very little resistance to the impacting vehicle.

While these conventional systems have proven successful, they also possess shortcomings. For example, these systems are typically employed where deemed necessary by traffic officials or government regulations. As a result, they are not used along all roadsides, but instead in sections. At the ends of these sections, the cables are anchored to the surface. Accordingly, the cables taper from their maximum height between the support posts to their minimum height at the surface. Since these conventional cable systems are not designed to give way, a vehicle striking the cable system longitudinally, or in line with the taper of the cables, is likely to ride up the tapered cables and initiate a rollover, thereby causing serious damage to the vehicle and severe, if not fatal, injuries to any passengers. This has become a more prevalent event as more roadside cable systems are now being installed with ends tangent to the roadway, instead of being flared away from it.

SUMMARY

The present invention is defined by the claims below. Embodiments of the present invention solve at least the above problems by providing a system and method for a device for releasing a cable of a safety system. The system and method disclose various features of the safety system as it applies to a roadway barrier system and other applications in the event that the cables are impacted proximate the region they are secured to the surface.

In a first aspect, a device for releasing a cable is disclosed comprising primarily an anchor bracket and a release lever. The release lever is located proximate the anchor bracket such that the release lever can pivot, upon impact of a load, to disengage one or more cables from the anchor plate.

In a second aspect, a device for releasing tension within a roadside safety system is disclosed. This system incorporates the aspects of an anchor bracket and release lever as previously described, but also includes other features of a roadside safety system such as vertically extending support posts, one or more cables extending between the support posts, and end terminals.

In a third aspect, a method of releasing one or more cables of a safety system is disclosed. This method discloses the steps necessary to release the one or more cables. This method is applicable to a variety of cable safety systems, including, but not limited to a roadside safety system.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Embodiments of the present invention provide systems and a method for releasing a cable of a safety system. Under certain circumstances, it may be necessary to release a cable, in tension, that is otherwise intended to serve as a safety system. Under these circumstances, it is desirable to provide such a system and method that is relatively simple, reliable, and reusable.

Figure 1A:
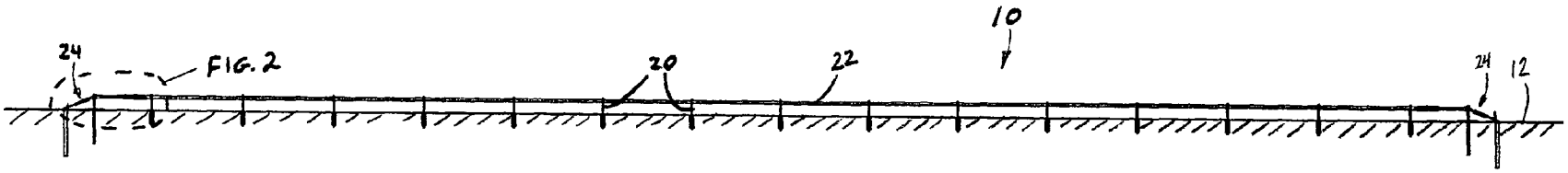
FIG. 1A is a side elevation view of a roadside safety system in accordance with an embodiment of the present invention.
Figure 1B:
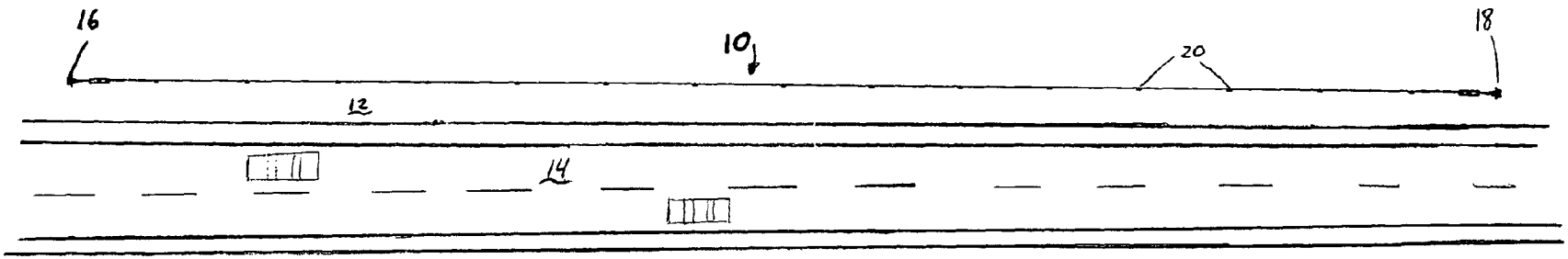
FIG. 1B is a top elevation view of a roadside safety system in accordance with an embodiment of the present invention.

Referring now FIGS. 1A and 1B, a roadside safety system 10 in accordance with the present invention is shown in detail. FIG. 1A shows a side elevation view of safety system 10 along a surface 12. FIG. 1B shows a top elevation view of roadside safety system 10 adjacent a two-lane road 14. Roadside safety system 10 can be secured to a surface 12, which may be the ground, or asphalt/concrete covered shoulder of road 14. The exact location varies and typically depends on the surrounding terrain and available property. As previously mentioned, roadside safety systems, such as the one depicted in FIGS. 1A and 1B, have ends, 16 and 18 respectively, and also a plurality of vertically extending support posts 20. Extending between support posts 20 are one or more cables 22, which are preferably constructed of steel. In the illustrated embodiment of the invention, three cables are utilized. The cables are anchored at ends 16 and 18 to surface 12. Further understanding of this transition region and anchoring region is shown in FIG. 2.

Figure 2:
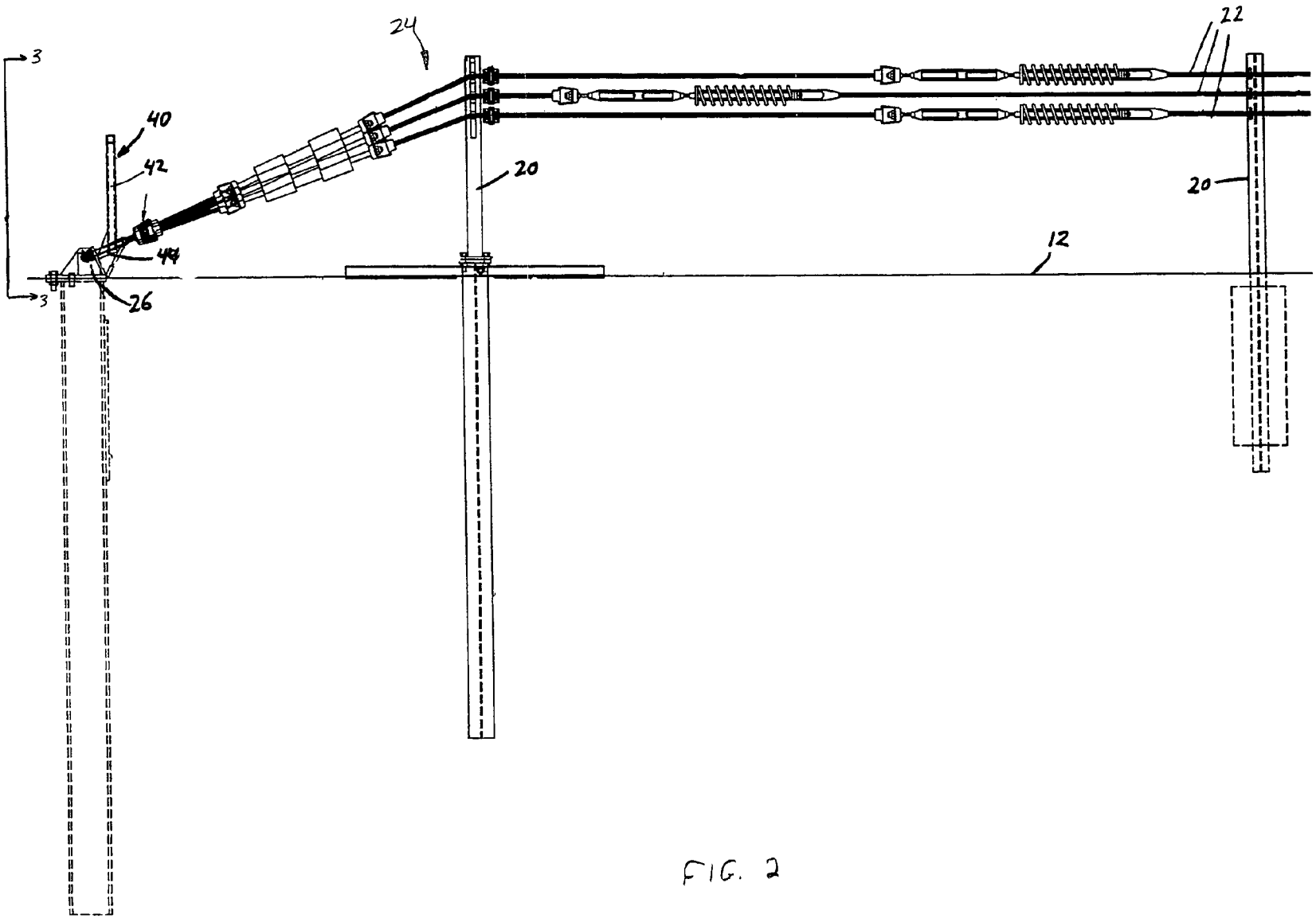
FIG. 2 is an side elevation view of an end terminal and cable release device in accordance with an embodiment of the present invention.

One feature depicted in FIG. 2 is an end terminal 24. It is at this location that cables 22 are directed towards an anchor plate 26 which is itself fixed to surface 12. As can be seen in FIG. 2, anchor plate 26 and support posts 20 are secured beneath surface 12 in order to provide the necessary structural support to absorb the load caused by a vehicular impact as well as to maintain the cables in tension. End terminals 24 are positioned at each end of safety system 10 as shown in FIG. 1A.

Figure 3:
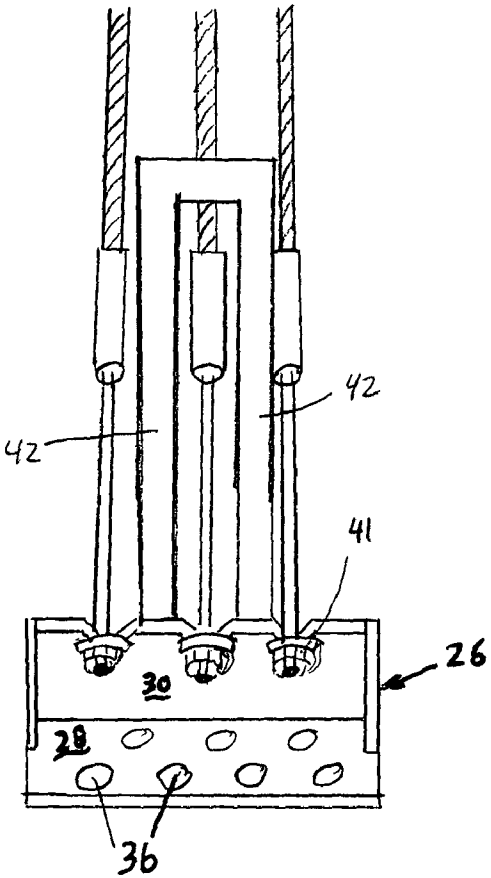
FIG. 3 is an end elevation view of the cable release device in accordance with an embodiment of the present invention.
Figure 4C:
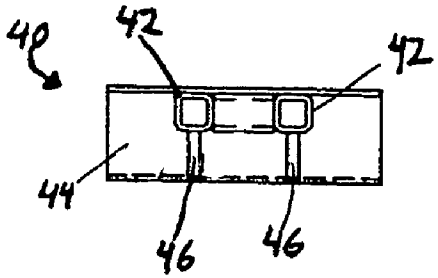
FIGS. 4A, 4B, and 4C are various views of a release lever in accordance with an embodiment of the present invention.
Figure 4A:
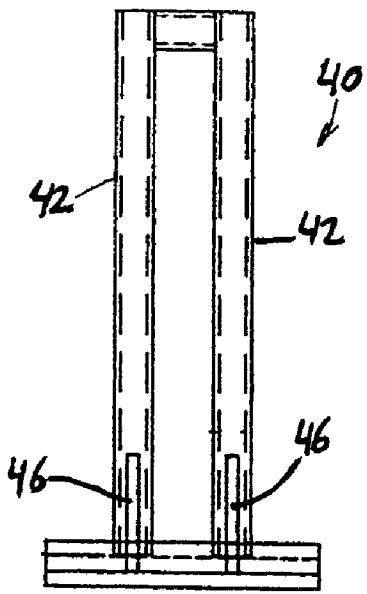
Figure 4B:
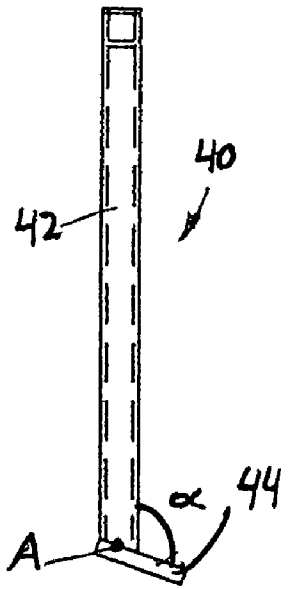
Figure 5C:
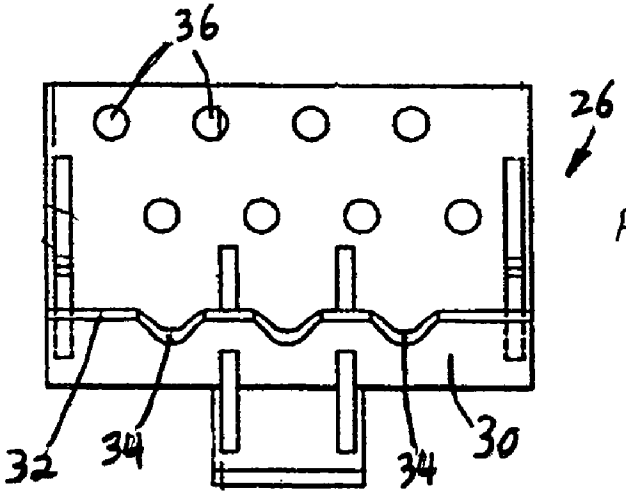
FIGS. 5A, 5B, and 5C are various views of an anchor bracket in accordance with an embodiment of the present invention.
Figure 5A:
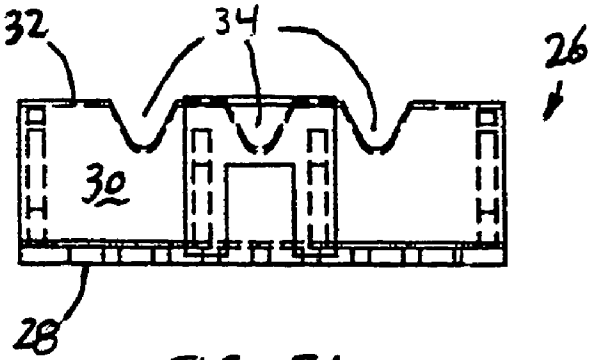
Figure 5B:
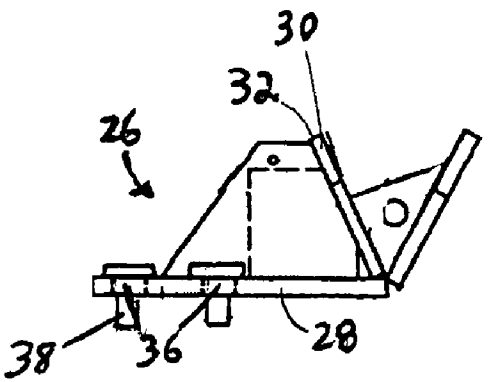

Referring now to FIGS. 3-5C, additional aspects of the present invention are disclosed in greater detail. An anchor bracket 26 comprises a base portion 28 and an end plate 30 that extends generally vertically from base portion 28 and has an upper edge 32. One or more slots 34, designed for receiving one or more cables 22 in tension, are positioned in end plate 30, along upper edge 32. The cables secured in slots 34 are shown in FIG. 3. Base portion 28 also has a plurality of openings 36 for securing anchor bracket 26 to surface 12. This securing is accomplished by a plurality of fasteners 38 (see FIG. 5B).

Another feature of the safety system is a release lever 40 which comprises at least one first leg 42 that is secured to a second leg 44. In the embodiment shown in FIGS. 3-4C, at least one first leg 42 comprises two generally parallel legs. Second leg 44, which is shorter than first leg 42, is positioned at an angle $\alpha$ relative to first leg 42. In order to minimize the time required for the release of cables 22 from the time of impact of lever 40, it has been determined that the angle $\alpha$ should be only slightly obtuse—approximately 90-105 degrees. To provide additional structural support to lever 40, the lever further comprises a plurality of gussets 46 that reinforce said first and second legs.

Release lever 40 is positioned proximate said anchor bracket 26 such that release lever 40 can pivot to disengage one or more cables 22 from anchor plate 26 by releasing nuts 41 from slots 34. In the example of a roadside safety system, upon impact with first leg 42, lever 40 pivots about a point A (see FIG. 4B) thereby raising second leg 44 to a height sufficient to raise ends of cables 22 from slots 34 in end plate 30. Once the cables are raised to the point that their securing means, E.g. nuts 41, clear slots 34, the contraction of the one or more cables 22 from its built-in tension allows the cables to collapse.

The means by which the collapse of cables 22 for a roadside safety system is possible is by means of a vehicle striking lever 40 at first leg 42. Depending upon the type of vehicle, most likely it will be the vehicle bumper which will strike first leg 42. After the cables 22 become disengaged from anchor plate 26, due to a vehicle striking lever 40, support posts 20 will breakaway from surface 12 as they are impacted by the vehicle.

Figure 6B:
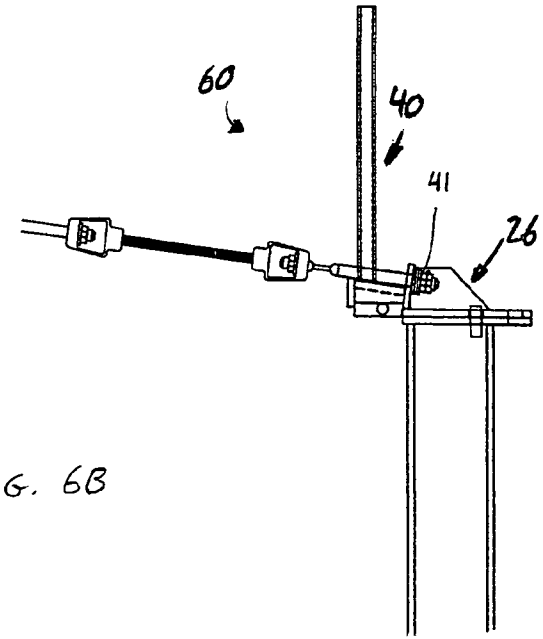
FIGS. 6A and 6B are top elevation and side elevation views, respectively, in accordance with a single cable embodiment of the present invention.
Figure 6A:
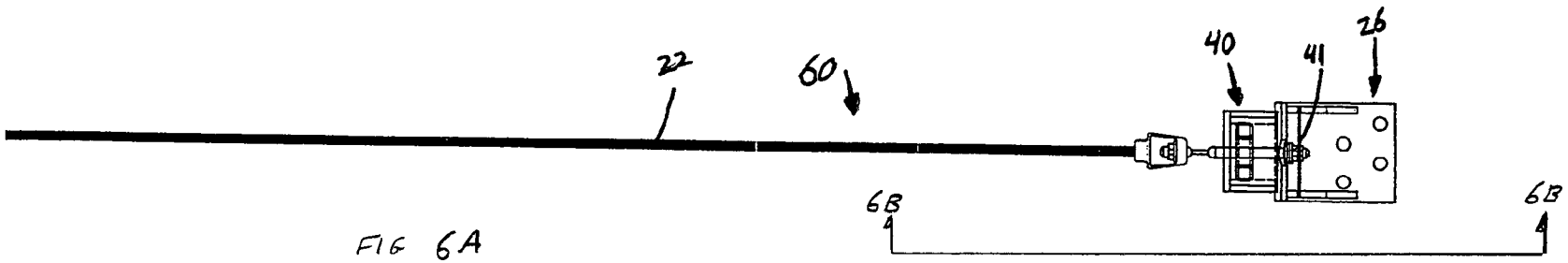
Figure 7:
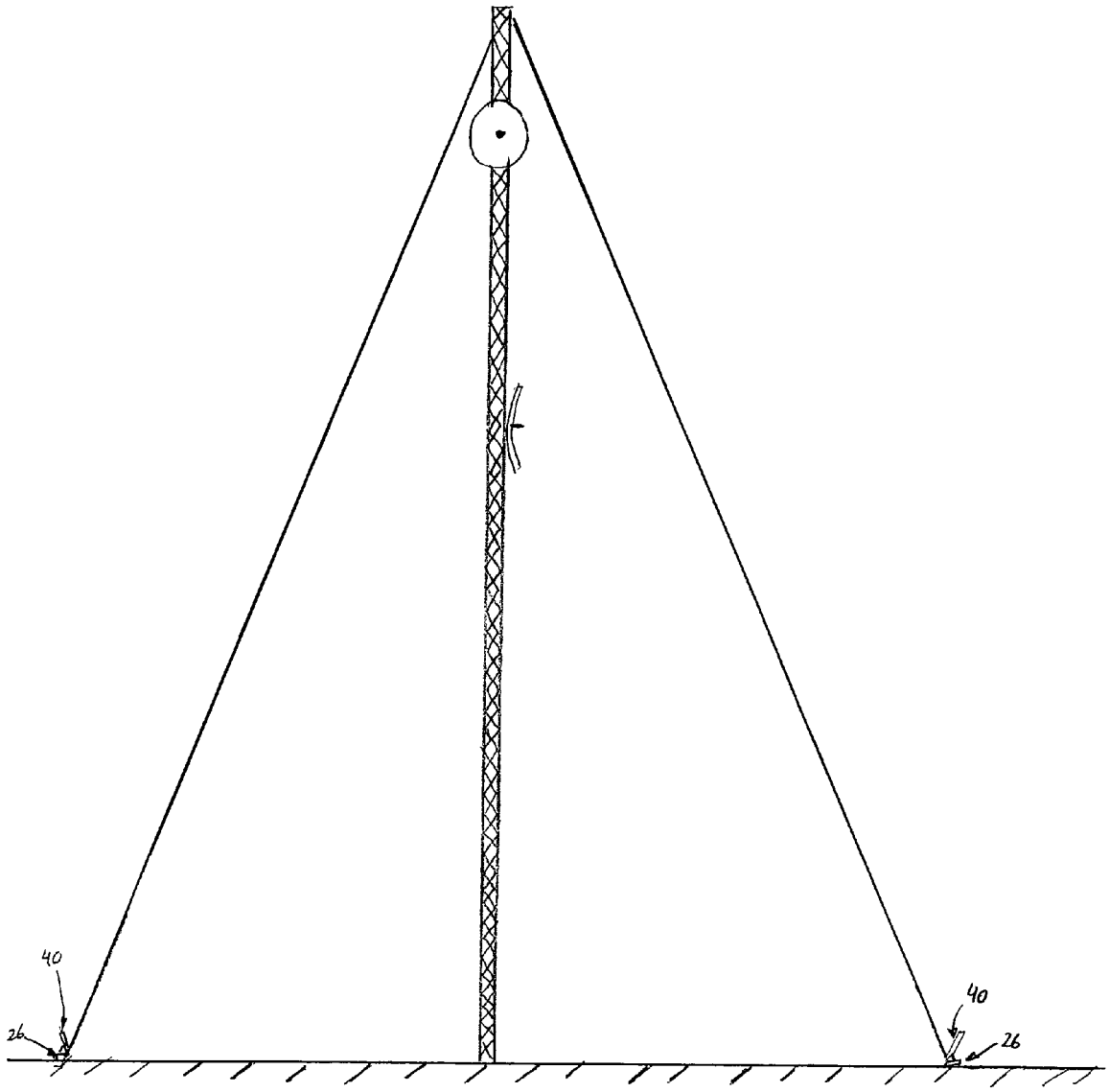
FIG. 7 is a side elevation view of a cable release device in accordance with an embodiment of the present invention.

While the system described up to this point, that provides the best understanding of the present invention, has been a roadside safety system, the present invention is not intended to be limited to that type of technology. On the contrary there are other fields in which a cable safety system is utilized, such as a mechanism for releasing securing cables for other structures. For example, with reference now to FIGS. 6A, 6B, and 7, a single-cable safety system 60 is shown in detail. In this arrangement, the same features as described above are utilized herein, including lever 40 and anchor plate 26. However, in this arrangement only, a single cable 22 is required. This type of cable safety system can be utilized for securing vertically extending structures, such as antennas, radio towers, safety fencing, etc. An example of such an arrangement is shown in FIG. 7. The lever in such a system is similar to the one shown in FIGS. 1-6 except that it only requires one slot.

The present invention also provides a method of releasing one or more cables of a safety system comprising the steps of providing an anchor bracket and a release lever as previously disclosed and impacting the release lever. The impact on the release lever causes a pivoting of the release lever such that the second leg of the lever pushes the ends of the one or more cables out of the slots in the anchor bracket, thereby releasing the tension in the one or more cables.

This method is applicable to a variety of cable safety system applications including a roadside safety system as well as the other applications previously discussed such as antennas, radio towers, fencing, to name a few generally vertically extending structures often requiring securing mechanisms.

This system and method as it applies to roadway safety systems was simulated and tested through careful experimentation by the inventors. Through computer simulations and scaled testing, they were able to verify that the cable ends of a three-cable system would properly release from an anchor bracket upon longitudinal impact of a moving vehicle (at approximately 45 mph), thus eliminating the tension in the cables and preventing the vehicle from climbing the inclined cables proximate the end terminal. For the system tested, it was determined from photographic evidence that the cables were released from the anchor bracket approximately 8 milliseconds after the vehicle impacted the first leg of the release lever. Significant reduction in cable tension was seen by approximately 18 milliseconds after vehicle impact. In this scaled testing, the release lever incorporated an angle $\alpha$ between its first leg and second leg of approximately 97.5 degrees. Reductions in vehicular velocity were detected at impact with the releasing lever as well as with each support post. Although the support posts did slow the vehicle they provide minimal resistance to an impact load and typically fractured.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A roadside safety system comprising: a plurality of vertically extending support posts placed along a surface; one or more cables extending between said support posts; and a cable release device; said cable release device further comprising:

an anchor bracket comprising a base portion and an end plate having one or more slots positioned therein, said slots for receiving one or more cables;

a release lever comprising at least one first leg coupled to a second leg, said second leg positioned at an angle relative to said first leg; and, wherein said release lever is positioned proximate to said anchor bracket such that a lateral force applied to said first leg is translated to a vertical force applied to said one or more cables by said second leg at a point distal to said first leg.

2. The roadside safety system of claim 1 wherein said one or more cables received in said slots are in tension.

3. The roadside safety system of claim 1 wherein said end plate extends in a generally vertical direction from said base portion.

4. The roadside safety system of claim 3 wherein said slot in said end plate is located along an upper edge of said end plate.

5. The roadside safety system of claim 1 wherein a plurality of fasteners extend through said openings for securing said anchor bracket to said surface.

6. The roadside safety system of claim 1 wherein said angle .alpha. is approximately 90-105 degrees.

7. The roadside safety system of claim 6 wherein said first leg is longer than said second leg.

8. The roadside safety system of claim 1 wherein said release lever further comprises a plurality of gussets for reinforcing said first and second legs.

9. The roadside safety system of claim 1 wherein said one or more cables are steel.

10. The roadside safety system of claim 1 wherein said support posts fracture upon impact of a vehicle.

11. The roadside safety system of claim 1 wherein said one or more cables are released from said anchor plate shortly after impact of a vehicle with said at least one first leg of said release lever.

12. The roadside safety system of claim 11 wherein said one or more cables comprises three cables.

13. The roadside safety system of claim 1 further comprising:

an end terminal located proximate said anchor bracket for directing said one or more cables in tension towards said anchor bracket.

* * * * *